US006412410B1

(12) United States Patent
Poullier

(10) Patent No.: US 6,412,410 B1
(45) Date of Patent: Jul. 2, 2002

(54) END SEALING SYSTEM FOR A SCRAPER CHAMBER

(75) Inventor: Bernard Poullier, Colmar (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 09/659,062

(22) Filed: Sep. 11, 2000

(51) Int. Cl.[7] ..... B41F 31/02
(52) U.S. Cl. ..... 101/363; 101/364; 101/350.6
(58) Field of Search ..... 101/363, 364, 101/365, 366, 350.1, 350.6, 207, 208, 210, 155, 157, 167, 169

(56) References Cited

U.S. PATENT DOCUMENTS

| | | | | | |
|---|---|---|---|---|---|
| 4,581,995 | A | * | 4/1986 | Stone | 101/366 |
| 4,821,672 | A | * | 4/1989 | Bruno | 101/169 |
| 5,182,992 | A | * | 2/1993 | Rogge | 101/363 |
| 5,596,927 | A | * | 1/1997 | Maurer et al. | 101/363 |
| 5,862,756 | A | * | 1/1999 | Gorter | 101/364 |
| 6,016,748 | A | * | 1/2000 | Kolbe et al. | 101/364 |

FOREIGN PATENT DOCUMENTS

| | | |
|---|---|---|
| DE | 42 14 792 A1 | 11/1993 |
| FR | 2 687 096 A1 | 8/1993 |

* cited by examiner

*Primary Examiner*—Leslie J. Evanisko
(74) *Attorney, Agent, or Firm*—Breiner & Breiner, L.L.C.

(57) ABSTRACT

The invention relates to an end sealing system for. a scraper chamber (6) of an impression machine or a machine depositing a viscous or liquid fluid on a surface, the chamber cooperating with a screen transfer cylinder (1) and being laterally closed by longitudinal scrapers (2). The system includes a mounting frame (3) housed at the end of the scraper chamber (6), an elongated seal (4) made of an elastically deforming alveolar material cooperating at its ends with the mounting frame (3), and a rigid second seal (5) mounted on the elongated seal (4) between the latter's ends, and being guided in the mounting frame (3). The ends of the elongated seal (4) rest under the ends of the scraper (2) on the side opposite the screen transfer cylinder (1). In particular, the invention can be used with a machine depositing a viscous or liquid fluid on relatively moving surfaces, in particular using impression cylinders or depositing cylinders, these cylinders being supplied with fluid from a screen transfer cylinder cooperating with a scraper chamber.

6 Claims, 1 Drawing Sheet

END SEALING SYSTEM FOR A SCRAPER CHAMBER

FIELD OF THE INVENTION

The present invention relates to machines for depositing a liquid or viscous fluid to moving surfaces, in particular by means of impression or deposition cylinders being fed with fluid by means of a screen transfer cylinder cooperating with a scraper chamber, the objective being an end sealing system for such scraper chamber.

BACKGROUND OF THE INVENTION

In general, the scraper chambers of printers or machines applying a viscous or liquid product consist of a longitudinal recess running over the full width and opposite a screened transfer cylinder and are fitted with feed means for a viscous or liquid fluid and further with means to deposit this fluid by aspiration onto the surface of the cylinder. These chambers include longitudinal scrapers running along generatrices of the transfer cylinder and serving, on one hand, to preclude the fluid from leaking out of the chamber and on the other hand to implement accurate application of the fluid volume as defined by the volume of the cylinder alveoles. In general, these scrapers are steel or plastic blades resting against the screen surface of the transfer cylinder.

The scraper chambers are fitted at their ends with a sealing system which may be a single or multiple seal resting against the corresponding ends of the screen transfer cylinder. This sealing system also applies the scrapers against the screen transfer cylinder by acting on their ends and by imparting to them a movement toward the screen cylinder.

More or less effective sealing systems are known in the state of the art, however they entail rapid scraper wear.

It is known, for example, to use a silicone seal mounted at the end of the scraper chamber and which closely follows its contour as well as that of the screen cylinder. This seal is forced against the end edges of the scraper chamber, against the scraper surface on the side opposite the screen cylinder, and against the corresponding end surface of the screen cylinder. However, such a sealing system allows sealing only for a short time because of being subjected to rapid wear caused by friction with the screen cylinder. Accordingly, this seal must be replaced frequently at corresponding machine shutdown and has corresponding loss in efficiency.

French patent application 2,687,096 describes a sealing system consisting of a set of parts. Such sealing system improves sealing at the ends of the scraper chamber because the parts resting against the end of the screen cylinder are subject to a more or less constant pressure easing wear. However, because these pressurized parts simultaneously force the corresponding ends of the steel or plastic scrapers against the screen cylinder, fairly rapid wear of scrapers and seals entails premature replacement.

Lastly, German patent application 4,241,792 discloses a scraper-chamber end sealing system consisting of a number of parts implementing a labyrinth seal to collect the fluid trying to escape at the ends of the screen cylinder. This seal is mounted between two adjoining alveolar elements pressed against a corresponding circumferential strip of the screen cylinder. The assembly so formed constitutes a sealing system elastically pressed against the corresponding end of the screen cylinder.

However, due to the labyrinth seal being made of an alveolar substance without compensating for losses in elasticity due to material fatigue, the sealing ability of this device soon becomes problematical because this labyrinth no longer is being sufficiently compressed. Moreover, because the scraper ends are forced against the screen cylinder solely by the pressure from the alveolar elements, their sealing ability suffers from the same problems as the labyrinth seal.

OBJECTS AND SUMMARY OF THE INVENTION

The objective of the present invention is to palliate these drawbacks by proposing an end sealing system for a scraper chamber of a printer or a machine depositing a viscous or liquid fluid on a surface, the sealing system ensuring constant sealing ability over an extended time at the ends of the screen transfer cylinder and of the scraper chamber while nevertheless avoiding premature cylinder wear, in particular in the case of mechanically engraved cylinders which then are chrome-plated, and/or scrapers, as well as sealing elements.

For that purpose, the end sealing system for a scraper chamber of a printing machine or a machine depositing a viscous or liquid fluid on a surface, where the chamber cooperates with the screen transfer cylinder, is characterized in that it includes a mounting frame housed at the end of the scraper chamber, an elongated seal made of a deforming alveolar material and cooperating at its ends with the mounting frame, and a rigid, second seal mounted on the elongated seal between the ends of the latter and guided in the mounting frame, the ends of the elongated seal resting underneath the scraper ends on the side opposite the screen transfer cylinder.

BRIEF DESCRIPTION OF THE DRAWINGS

The invention is elucidated in the following description of a preferred illustrative and non-limiting embodiment and in relation to the attached diagrammatic drawings.

DESCRIPTION OF PRESENTLY PREFERRED EMBODIMENTS

Figure 1:
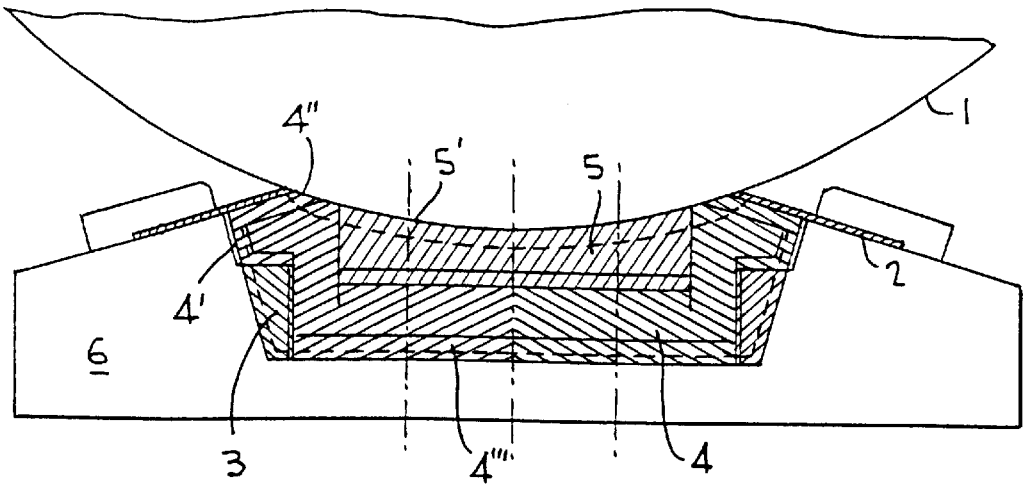
FIG. 1 is a sectional, partial side view elevation of a system of the invention, in position in the scraper chamber and against the transfer cylinder.
Figure 2:
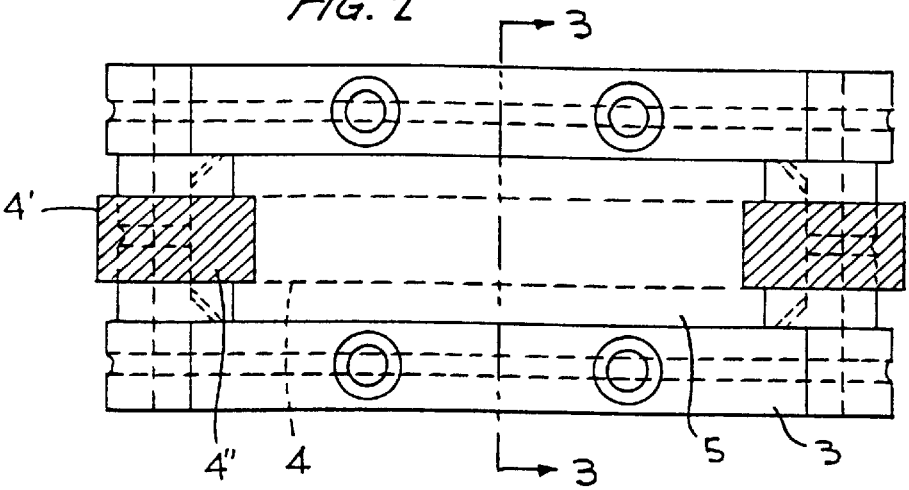
FIG. 2 is a top view of the system of FIG. 1 in isolation.
Figure 3:
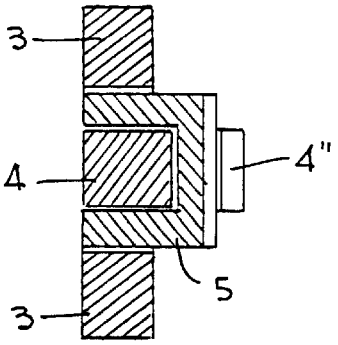
FIG. 3 is a sectional view along A—A of FIG. 2.

FIGS. 1 and 2 show a sealing system for a scraper chamber 6 for an impression machine or a machine depositing a viscous or liquid fluid on a surface. This chamber 6 cooperates with a screen transfer cylinder 1 and is laterally closed by longitudinal scrapers 2.

In the invention, this end sealing system essentially includes a mounting frame 3 housed in the end of the scraper chamber, an elongated seal element 4 made of an elastically deforming alveolar material and cooperating at its ends with the mounting frame 3, and a rigid second seal 5 mounted on the elongated seal 4 between the latter's ends and guided in the mounting frame 3, the ends of the elongated seal 4 pressing underneath the ends of the scrapers 2 on the side opposite the screen transfer cylinder 1.

The elongated seal 4 made of an elastically deforming alveolar material, preferably, assumes the form of a yoke 4''' with elongated crossbar and of which the ends 4' of the legs curve outward and rest on corresponding edges of the mounting frame 3 to form a receiving cradle for the elongated seal 4.

The rigid second seal 5 is in the form of an element including an inward-curving surface 5' of which the radius is identical with that of the screen transfer cylinder 1 and this element by this inward curving surface 5' presses against the cylinder; at its side opposite the inward curving surface 5', the element includes a longitudinal housing of which the cross-section corresponds to that of the crossbar of the yoke forming the elongated seal 4. The ends of this element are in the shape of a fork which, in the operational position, will enclose the legs of the yoke constituting the elongated seal 4.

The design of the sealing system of the invention allows applying constant pressure on one hand to the rigid second seal 5 against the corresponding end of the screen transfer cylinder 1 and on the other hand to compress the end of the scrapers 2 against the screen transfer cylinder 1 on account of the thrust generated by the elongated seal 4 mounted in the mounting frame 3. This feature is possible because the seal 4 is elastically deforming and thereby the scraper chamber 6 being forced against the screen transfer cylinder 1 pushes the rigid second seal 5 toward the mounting frame 3 to compress the elongated seal 4. Consequently, an equilibrium position results from the rigid second seal 5 sufficiently compressing the corresponding surface of the screen transfer cylinder 1. As a by-product of the thrust exerted by the scraper chamber 6, the scrapers 2 rest against the corresponding generatrices of the screen transfer cylinder 1 and, on the opposite side, their ends rest against the ends 4' of the legs of the yoke constituting the elongated seal 4. This compression furthermore entails an elastic reaction keeping the ends of the scrapers 2 against the screen transfer cylinder 1.

As shown in particular in FIG. 1, the ends 4' of the legs of the yoke forming the elongated seal 4 slope to push the scrapers 2 against the screen transfer cylinder 1 and are fitted with a chamfer 4" sloping toward the rigid second seal 5. In this manner, the scrapers are pressed against the screen transfer cylinder 1 along the angle determined by the ends 4' on one hand and on the other hand the chamfers 4" on either side of the rigid second seal 5 to allow forming a lubricating film on the ends of the screen transfer cylinder 1. As a result, any fluid retained near the ends 4' of the elongated seal 4 can be moved by the alveolar material of the seal 4 near the chamfers 4" and by capillarity can form a lubricating film.

Preferably, the elongated seal 4 is a neoprene cellular synthetic foam commercially known as PORON and made by ROGERS N.V. Co. Such a foam allows absorbing some fluid and consequently it is kept moist when the machine is shut down and seal drying is averted. Furthermore, encrusting phenomena also are avoided.

The rigid second seal 5 preferably is very high-density polyethylene-based plastic with a solid lubricant additive, such as is commercially known as CESTITECH 7000 made by DSM Co.

The sealing system of the invention offers good sealing at the ends of a scraper chamber because the rigid second seal 5 is forced at a sufficiently high, although not excessive, constant pressure against the corresponding end of the screen transfer cylinder 1, and its wear is automatically compensated by the deformation of the elongated seal 4 compressed by the rigid second seal 5 in the mounting frame 3. Furthermore, this elongated seal 4 allows absorbing any shifts of the scraper chamber 6 relative to the screen transfer cylinder 1.

Also, the elongated seal 4 absorbs some of the fluid retained by the system of the invention to use it as a peripheral lubricant film at the end of the transfer cylinder 1 and thereby it avoids dryouts during machine shutdown.

Also the scrapers 2 are forced by their ends against the screen transfer cylinder 1 at a low but sufficient pressure whereby, on one hand, wear of the ends of the scrapers 2 is averted, and on the other hand premature wear of the ends of the screen transfer cylinder 1 will not take place, in particular as regards mechanically engraved cylinders. This advantage also applies to forcing the rigid second seal 5 against the end of the screen cylinder 1 and to the wear between these elements.

The invention allows sealing the ends of the scraper chambers by using simple means, the wear of these chambers being substantially less than in the heretofore known systems, and the invention moreover implements automatic compensation due to wear while providing constant compression of the screen transfer cylinder.

Obviously the invention is not restricted to the above described embodiment shown in the attached drawings. The invention can be modified, in particular as regards the nature of the various elements or by substituting equivalent techniques, without thereby transcending the scope protected by the invention.

It is claimed:

1. A sealing system adapted to seal an end of a scraper chamber of a machine for depositing a viscous or liquid fluid on a surface, said scraper chamber cooperating with a screen transfer cylinder and being laterally closed by longitudinal scrapers, said sealing system comprising a mounting frame adapted to be received at the end of the scraper chamber, an elongated seal made of a deforming alveolar material which cooperates with the mounting frame, and a second seal mounted on the elongated seal between ends of the elongated seal, the ends of the elongated seal being adapted to rest under ends of the longitudinal scrapers which are positioned opposite the screen transfer cylinder and the ends of the elongated seal are fitted with a chamfer sloping toward the second seal to allow forming a lubricating film on ends of the cylinder.

2. System as claimed in claim 1 wherein the elongated seal is in a form of a yoke having an elongated crossbar with ends extending outward and resting against corresponding edges of the mounting frame which forms a cradle for said elongated seal.

3. System as claimed in claim 2 wherein the second seal is in a form of an element having an inwardly curving surface of a radius same as the screen transfer cylinder, said inwardly curving surface being adapted to rest against said cylinder, said element being fitted on a side opposite the inwardly curving surface with a longitudinal housing having a cross-section corresponding to that of the yoke, ends of the element being constructed and arranged so that in an operational mode said ends of the element enclose the ends of the yoke.

4. System as claimed in claim 2 wherein the ends of the yoke slope in such a manner as to be adapted to force the longitudinal scrapers against the screen transfer cylinder.

5. System as claimed in claim 1 wherein the elongated seal is made of a sealing cellular synthetic foam.

6. System as claimed in claim 1 wherein the rigid second seal is made of a high-density polyethylene-based plastic with a solid lubricant additive.

* * * * *

UNITED STATES PATENT AND TRADEMARK OFFICE

CERTIFICATE OF CORRECTION

PATENT NO. : 6,412,410 B1
DATED : July 2, 2002
INVENTOR(S) : Bernard Poullier

It is certified that error appears in the above-identified patent and that said Letters Patent is hereby corrected as shown below:

Title page,
Item [57], ABSTRACT,
Line 1, “for.a” should read -- for a --.

Column 4,
Line 63, “the rigid second” should read -- the second --.

Signed and Sealed this

Fourth Day of February, 2003

JAMES E. ROGAN
*Director of the United States Patent and Trademark Office*